United States Patent [19]

Handler

[11] Patent Number: 5,009,351

[45] Date of Patent: Apr. 23, 1991

[54] SHEET-MATERIAL DISPENSING BOX

[76] Inventor: Vivian M. Handler, 1727 David St., Pensacola, Fla. 32514

[21] Appl. No.: 235,623

[22] Filed: Aug. 24, 1988

[51] Int. Cl.[5] ..... B26F 3/02

[52] U.S. Cl. ..... 225/52; 225/26; 225/53

[58] Field of Search ..... 225/39, 44, 48, 51, 225/52, 53, 90, 77, 79

[56] References Cited

U.S. PATENT DOCUMENTS

| | | | |
|---|---|---|---|
| 2,825,451 | 3/1958 | Henry | 225/51 |
| 2,825,452 | 3/1958 | Klein | 225/47 |
| 3,028,060 | 4/1962 | Haley | 225/53 |
| 3,229,876 | 1/1966 | Osborn, Jr. | 225/49 |
| 4,334,644 | 6/1982 | Hauser | 225/84 X |
| 4,648,536 | 3/1987 | VanderLugt | 225/90 |

FOREIGN PATENT DOCUMENTS

| | | | |
|---|---|---|---|
| 451119 | 6/1935 | France | 225/46 |

*Primary Examiner*—Hien H. Phan
*Attorney, Agent, or Firm*—Kelly O. Corley

[57] ABSTRACT

The new free end formed when a portion of flexible sheet material is severed from a roll contained in a box is prevented from retracting into the box by frictional engagement between the free end and a strip of abrasive material near the cutting edge mounted on the box. A portion of the box closure resiliently urges the free end into contact with the abrasive material.

8 Claims, 1 Drawing Sheet

SHEET-MATERIAL DISPENSING BOX

The invention relates to the art of boxes for dispensing sheet material, and more particularly to an improved and simplified and disposable box of the above character.

Sheet materials such as plastic films, waxed paper, etc., are commonly sold in boxes designed such that a portion of the sheet material is withdrawn and severed by a built-in blade from the remainder of the sheet material contained within the box. Particularly with plastic films, the problem arises that when the portion is cut free, there is sufficient elasticity in the sheet material that the newly formed free end tends to retract into the box, necessitating opening the box to retrieve the free end in order to dispense the next portion.

Numerous proposed solutions are to be found in the prior art, but are typically relatively complex and expensive, particularly as compared to a simple box formed from cardboard or the like. One commercially available solution to the problem leaves a portion of the newly formed free end hanging outside the box and thus exposed to dust and other contaminants.

According to a first major aspect of the invention, these and other problems with the prior art are avoided by provision of a box for holding and dispensing a roll of flexible sheet material, the box comprising bottom, top, rear and end walls, the front wall having a top forward edge and the bottom wall terminating in a lower forward edge. A cutting edge is mounted on the lower forward edge, whereby a portion of the sheet material may be severed from the remainder of the sheet material, and an abrasive material is mounted rearwardly of the cutting edge in the interior of the box on the bottom wall, whereby the sheet material passes over and in contact with the abrasive material on the way to the cutting edge. The invention further comprises biasing means for resiliently biasing tho sheet material into light frictional contact with the abrasive material, whereby a portion of the sheet material may be pulled past the abrasive material in preparation for dispensing a portion of the sheet material, the frictional contact being sufficiently great that the new free end of the sheet material created when a portion of the sheet material is severed by the cutting edge is restrained from re-entering the box.

Preferably, the biasing means comprises a forward wall comprising a first portion sloping downwardly and inwardly from the top forward edge to a horizontal fold line; and a second portion sloping downwardly and outwardly from the fold line, the second portion terminating in an edge pressing the sheet material into the frictional contact. Preferably, the box further contains retaining means for retaining the second portion in position. The retaining means preferably comprises a tab extending inwardly from one of the end walls and engaging the forward wall.

The abrasive material preferably consists essentially of abrasive particles having an average particle size less than 20 microns bonded to the bottom wall by an adhesive matrix, and an average particle size less than 10 microns is particularly preferred, with the optimal range being between 4 and 10 microns.

Advantageously, the box further comprises a cut-out portion near the center of the edge of the second portion, whereby the free end of the sheet material may be grasped.

According to a second major aspect of the invention, there is provided a box for holding and dispensing flexible sheet material, the box comprising bottom, top, rear and end walls, the top wall having a top forward edge and the bottom wall terminating in a lower forward edge. A cutting edge is mounted on the lower forward edge, whereby a portion of the sheet material may be severed from the remainder of the sheet material, and a friction member is mounted rearwardly of the cutting edge on the interior of the box and above the bottom wall, whereby the sheet material passes over and in contact with the friction member on the way to the cutting edge, the friction member having a higher coefficient of friction with the sheet material than the walls.

The invention further comprises biasing means for resiliently biasing the sheet material into light frictional contact with the friction member, whereby a portion of the sheet material may be pulled past the friction member in preparation for dispensing a portion of the sheet material, the frictional contact being sufficiently great that the new free end of the sheet material created when a portion of the sheet material is cut off is restrained from re-entering the box, the biasing means comprising a forward wall of the box, the forward wall comprising a first portion sloping downwardly from the top forward edge to a horizontal fold line; and a second portion sloping downwardly and outwardly from the fold line, the second portion terminating in an edge pressing the sheet material into the noted frictional contact.

Other aspects of the invention will in part appear hereinafter and will in part be apparent from the following detailed description taken together with the accompanying, wherein.

Figure 1:
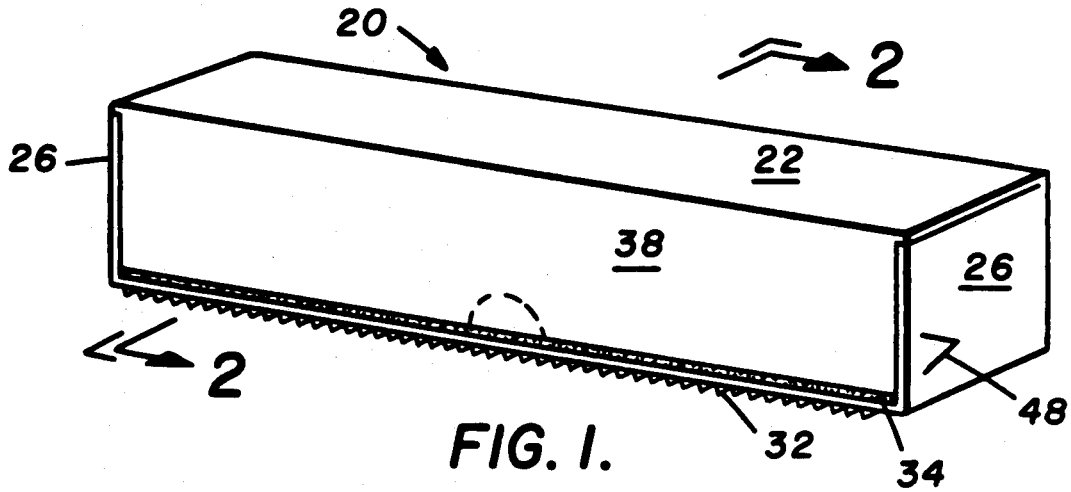
FIG. 1 is a perspective view of the preferred box of the invention prior to use.

Referring to the FIGURES, box 20 for holding and dispensing roll of sheet material is generally conventional except as noted herein, and is preferably formed from cardboard or a similar material. Box 20 comprises top wall 22, rear wall 24, end walls 26, and bottom wall 28 terminating in lower forward edge 30. Cutting edge 32, which may be in the form of a metal strip having a serrated edge, is mounted on lower forward edge 30 and protrudes therefrom slightly.

A strip of abrasive material 34 mounted rearwardly of cutting edge 32 in the interior of box 20 on bottom wall 28 whereby the sheet material being withdrawn passes over and in contact with abrasive material 34 on its way to cutting edge 32. Abrasive material 34 constitutes a frictional member having a higher coefficient of friction with the sheet material than bottom wall 28, and preferably consists essentially of abrasive particles having an average particle size less than 20 microns bonded to bottom wall 28 by an adhesive matrix, similar to the striking strip on the conventional book of paper matches. Advantageously, the average particle size is less than 10 microns, with the preferred range being between 5 and 10 microns. The abrasive particles may be selected from any of the conventional abrasive materials, such as aluminum oxide, silicon carbide, quartz, flint, garnet, etc.

Box 20 further comprises forward wall comprising a first portion 38 extending downwardly (FIG. 1) from top forward edge or fold line 40 of upper surface 22, thus forming the openable closure or cover of box 20. A second portion of the forward wall is flap 42, which is an extension of and is connected to first portion 38 along horizontal fold line 44. In the position illustrated in FIGS. 1 and 2, flap 42 extends horizontally toward rear wall 24 and rests on abrasive material 34.

For dispensing the first portion of the sheet material, forward wall 38 and its flap 42 are pulled outwardly to expose roll 21. The free end of the sheet material is then grasped and a portion of the sheet material is unrolled from roll 21. Flap 42 is then bent along fold line 44 in the reverse direction, and first portion 38 and flap 42 are then pushed into the position illustrated in FIGS. 3 and 4. In this position, first portion 38 and flap 42 constitute biasing means for resiliently biasing the sheet material into light frictional contact with abrasive material 34. This permits a portion of the sheet material to be pulled past abrasive material 34 in preparation for dispensing a portion of the sheet material. The frictional contact is sufficiently great that the new free end created when a portion 43 of the sheet material is severed by cutting edge 32 is restrained from re-entering box 20.

Figure 2:
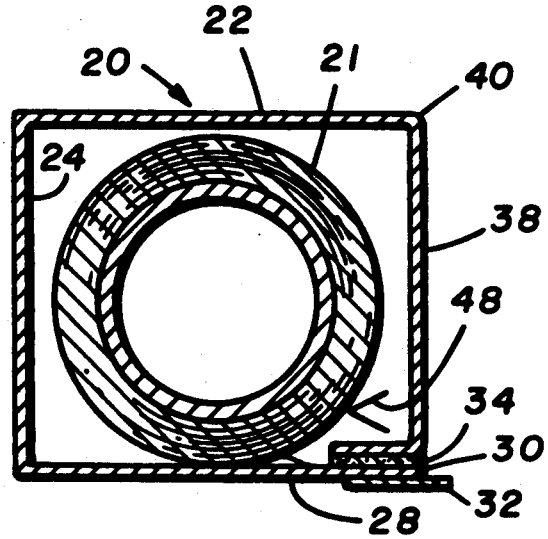
FIG. 2 is a sectional view taken along line 2—2 in FIG. 1.
Figure 3:
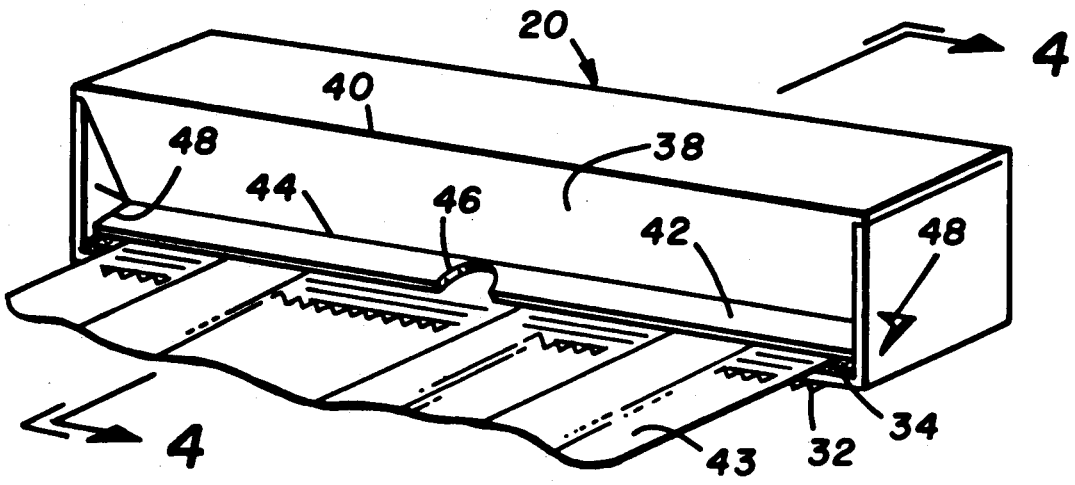
FIG. 3 is a perspective view of the preferred box readied for its intended use.

In the FIGS. 2 and 3 position, first portion 38 slopes downwardly and inwardly from top forward edge 40 to horizontal fold line 44, while second portion or flap 42 slopes downwardly and outwardly from fold line 44 to terminate in an edge resting on and pressing the sheet material into frictional contact with abrasive material 34.

Cut-out 46 is preferably provided near the center of tho edge of flap 42 to permit grasping of the free end of the sheet material.

Figure 4:
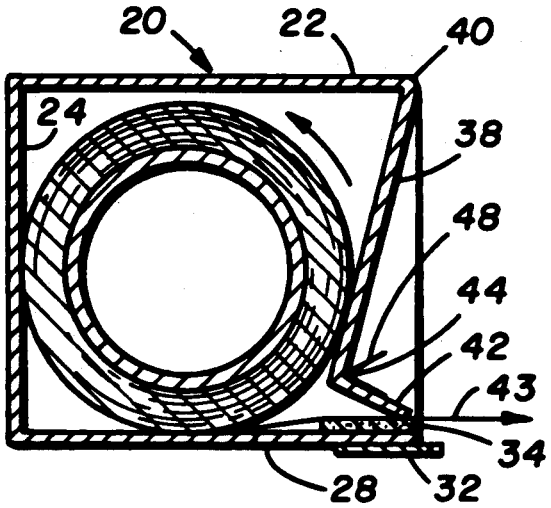
FIG. 4 is a sectional view taken along line 4—4 in FIG. 3.

In order to retain the forward wall and flap 42 in particular in the FIGS. 3 and 4 position, V-shaped cuts in end walls 26 define tabs 48 which are pushed inwardly to engage the forward wall, preferably in the vicinity of horizontal crease 44.

I claim:

1. A container for holding and dispensing a roll of flexible sheet material, said container comprising:

a. a box for containing said roll, said box comprising bottom, top, rear and end walls, said top wall having a top forward edge and said bottom wall terminating in a lower forward edge;

b. a cutting edge mounted on said lower forward edge, whereby a portion of said sheet material may be severed from the remainder of said sheet material, c. an abrasive material mounted rearwardly of said cutting edge in the interior of said box and on said bottom wall, whereby said sheet material passes over and in contact with said abrasive material on the way to said cutting edge; and d. biasing means for resiliently biasing said sheet material into light frictional contact with said abrasive material, whereby a portion of said sheet material may be pulled past said abrasive material in preparation for dispensing a portion of said sheet material, said frictional contact being sufficiently great that the new free end of said sheet material created when a portion of said sheet material is severed by said cutting edge is restrained from re-entering said box, said biasing means comprising a front wall, said front wall comprising:

(1) a first portion sloping downwardly and inwardly from said top forward edge to a horizontal fold line; and (2) a second portion sloping downwardly and outwardly from said fold line, said second portion terminating in an edge pressing said sheet material into said frictional contact; and (e) detaining means for retaining said second portion in position, said retaining means comprising a tab extending inwardly from one of said end walls and engaging said front wall.

2. A container for holding and dispensing a roll of flexible sheet material, said container comprising:

a. a box for containing said roll, said box comprising bottom, top, rear and end walls, said top wall having a top forward edge and said bottom wall terminating in a lower forward edge;

b. a cutting edge mounted on said lower forward edge, whereby a portion of said sheet material may be severed from the remainder of said sheet material;

c. an abrasive material mounted rearwardly of said cutting edge in the interior of said box and on said bottom wall, whereby said sheet material passes over and in contact with said abrasive material on the way to said cutting edge; and d. biasing means for resiliently biasing said sheet material into light frictional contact with said abrasive material, whereby a portion of said sheet material may be pulled past said abrasive material in preparation for dispensing a portion of said sheet material, said frictional contact being sufficiently great that the new free end of said sheet material created when a portion of said sheet material is severed by said cutting edge is restrained from re-entering said box.

3. The container defined in claim 2, wherein said biasing means comprises a forward wall, said forward wall comprising:

a. a first portion sloping downwardly and inwardly from said top forward edge to a horizontal fold line; and b. a second portion sloping downwardly and outwardly from said fold line, said second portion terminating in an edge pressing said sheet material into said frictional contact.

4. The container defined in claim 3, further comprising retaining means for retaining said second portion in position.

5. The container defined in claim 3, further comprising a cut-out portion near the center of said edge of said second portion, whereby the free end of said sheet material may be grasped.

6. The container defined in claim 2, wherein said abrasive material consists essentially of abrasive particles having an average particle size less than 20 microns bonded to said bottom wall by an adhesive matrix.

7. The container defined in claim 6, wherein said average particle size is less than 10 microns.

8. The container defined in claim 7, wherein said average particle size is between 5 and 10 microns.

* * * * *